US008201688B2

(12) United States Patent
Burfiend et al.

(10) Patent No.: US 8,201,688 B2
(45) Date of Patent: Jun. 19, 2012

(54) POUCH WITH SIDE GUSSETS FOR USE IN CARRYING FLUID FOR PERSONAL HYGIENE DEVICE

(75) Inventors: James R. Burfiend, Maidstone (GB); Daniel J. Greene, Seattle, WA (US)

(73) Assignee: Proctor and Gamble Corporation, Cincinnati, OH (US)

( * ) Notice: Subject to any disclaimer, the term of this patent is extended or adjusted under 35 U.S.C. 154(b) by 724 days.

(21) Appl. No.: 10/562,273

(22) PCT Filed: Jun. 21, 2004

(86) PCT No.: PCT/IB2004/050953

§ 371 (c)(1),
(2), (4) Date: Dec. 22, 2005

(87) PCT Pub. No.: WO2005/000079

PCT Pub. Date: Jan. 6, 2005

(65) Prior Publication Data

US 2008/0137998 A1 Jun. 12, 2008

Related U.S. Application Data

(60) Provisional application No. 60/482,914, filed on Jun. 27, 2003.

(51) Int. Cl.
*B65D 83/10* (2006.01)

(52) U.S. Cl. ..... 206/361; 206/277; 206/823; 383/120; 222/572

(58) Field of Classification Search ..... 206/361, 206/277, 823, 219–221; 383/120, 119, 105, 383/107, 108; 222/566, 572, 574, 92
See application file for complete search history.

(56) References Cited

U.S. PATENT DOCUMENTS

| | | | | | |
|---|---|---|---|---|---|
| 3,472,130 | A | | 10/1969 | Brockmuller | |
| D236,386 | S | * | 8/1975 | Katzman et al. | D24/118 |
| 4,394,936 | A | * | 7/1983 | Shavit | 222/107 |
| 4,467,588 | A | * | 8/1984 | Carveth | 206/219 |
| 4,614,267 | A | * | 9/1986 | Larkin | 206/221 |
| 4,669,124 | A | * | 5/1987 | Kimura | 383/80 |
| 4,903,718 | A | * | 2/1990 | Sullivan | 134/184 |
| 4,913,561 | A | * | 4/1990 | Beer | 383/94 |
| 5,373,965 | A | | 12/1994 | Halm et al. | |
| 5,433,526 | A | * | 7/1995 | Wild | 383/35 |
| 5,547,284 | A | * | 8/1996 | Imer | 383/104 |
| 5,611,461 | A | * | 3/1997 | Kubota et al. | 222/105 |

(Continued)

FOREIGN PATENT DOCUMENTS

| | | |
|---|---|---|
| CH | 283275 | 5/1952 |

(Continued)

*Primary Examiner* — J. Gregory Pickett
*Assistant Examiner* — Andrew Perreault

(57) ABSTRACT

The flexible fluid-carrying pouch for use with a personal hygiene device includes a front panel portion, a rear panel portion and two side edge gussets connecting the front and rear panel portions. The pouch is sealed along a bottom edge. The pouch includes a top edge which has a central portion which is sealed against a spout element, which permits exit of the fluid from the pouch, and further has two sealed side wing portions which extend upwardly alongside the spout element, providing a jogged arrangement for the top edge of the pouch.

4 Claims, 3 Drawing Sheets

U.S. PATENT DOCUMENTS

| | | | | |
|---|---|---|---|---|
| 5,788,121 | A * | 8/1998 | Sasaki et al. | 222/105 |
| 6,142,341 | A * | 11/2000 | Uematsu | 222/92 |
| 6,193,416 | B1 * | 2/2001 | Kawamata et al. | 383/104 |
| 6,220,702 | B1 * | 4/2001 | Nakamura et al. | 347/86 |
| 6,296,388 | B1 | 10/2001 | Galomb et al. | |
| 6,302,300 | B1 * | 10/2001 | Bosch | 222/107 |
| 6,419,117 | B1 * | 7/2002 | Bosch | 222/1 |
| 6,752,264 | B2 * | 6/2004 | Versluys | 206/219 |
| D502,604 | S * | 3/2005 | Haefele et al. | D4/113 |
| 6,918,153 | B2 * | 7/2005 | Gruber | 15/22.1 |
| 2002/0168120 | A1 | 11/2002 | Wessling et al. | |
| 2005/0031230 | A1 * | 2/2005 | Emst et al. | 383/107 |

FOREIGN PATENT DOCUMENTS

| | | | |
|---|---|---|---|
| EP | 0002328 | A1 | 6/1978 |
| EP | 0002326 | A1 | 6/1979 |
| EP | 0300789 | A2 | 1/1989 |
| EP | 1013449 | A2 | 6/2000 |
| GB | 2358388 | A | 7/2001 |
| JP | 06331610 | A | 12/1994 |
| JP | 10203542 | A | 8/1998 |
| WO | 9621387 | | 7/1996 |
| WO | 9813272 | | 4/1998 |
| WO | WO9813272 (A1) | | 4/1998 |

* cited by examiner

POUCH WITH SIDE GUSSETS FOR USE IN CARRYING FLUID FOR PERSONAL HYGIENE DEVICE

CROSS REFERENCE TO RELATED APPLICATION

This application claims the benefit of U.S. provisional application Ser. No. 60/482,914 filed Jun. 27, 2003, which the entire subject matter is incorporated herein by reference.

This invention relates generally to containers for fluid which may be used in a personal hygiene device, such as a fluid-dispensing toothbrush, and more specifically concerns a pouch container having a flexible construction which can conform to a particular space in the hygiene device.

Containers, i.e. bags or pouches, are well known for use as a reservoir for carrying fluid in fluid-dispending personal care appliances, such as shavers. Containers, generally in the form of tubes and cartridges, are also used to carry fluid for toothbrushes. Typically, however, such containers all have a particular configuration, including a straight top edge from which a fluid fill/exit member or spout extends and a defined volume configuration with a specific length, width and depth.

While such containers are known to be made from flexible material, typically the arrangement is such that the bag does not expand during filling but has a generally similar shape and configuration when empty or full. Such an arrangement limits the capability of the bag to fit into confined or unusually shaped spaces within the device, while maintaining maximum possible volume when filled. In personal care appliances, the space available for a fluid reservoir bag is usually quite limited and/or has an unusual configuration. Hence, it is desirable that a fluid-carrying bag for personal hygiene devices have a capability of fitting into close or irregular spaces within the hygiene device.

Accordingly, the invention, in one aspect thereof, is a flexible container for a fluid, for use with a personal hygiene device, comprising: a flexible bag having a front panel portion, a rear panel portion, and further having a gusset along at least one longitudinal side thereof connecting the front and rear panel portions, which allows the front and rear panel portions to expand away from each other when the bag is filled, wherein the bag has a top edge which is sealed to a spout element to permit exit of the fluid from the bag.

In another aspect, the invention comprises a flexible container for a fluid, for use with a personal hygiene device, comprising: a flexible bag having a front panel portion and a rear panel portion and sealed along a bottom edge thereof, wherein the bag includes two sealed wing portions on either side of a lower central portion at a top end thereof, wherein the wing portions extend above a remainder of the bag, permitting the remainder of the bag to fill completely.

Figure 1:
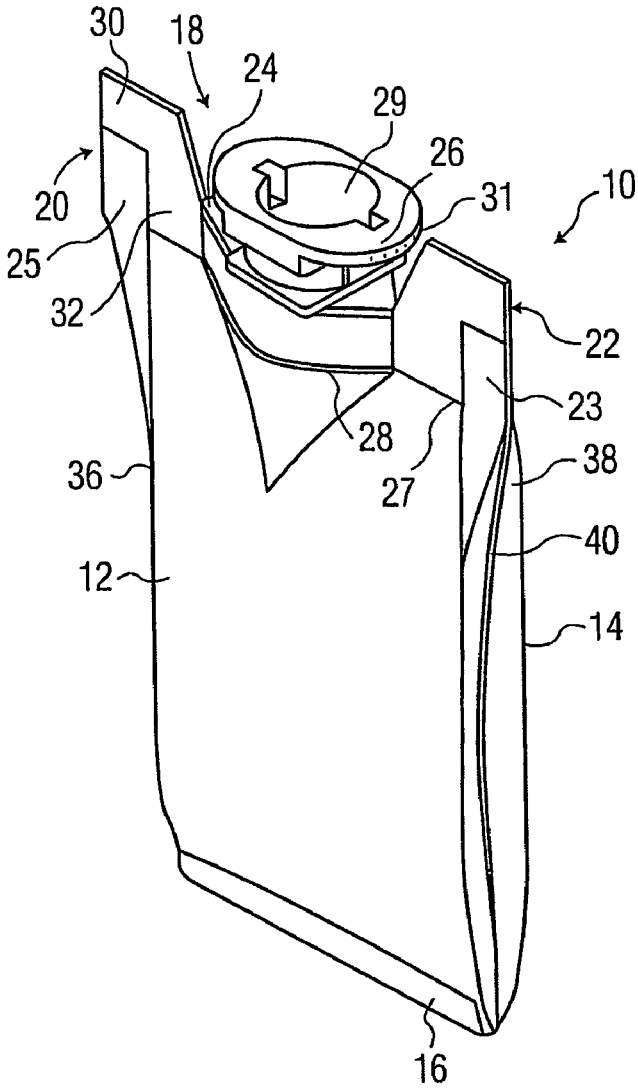
FIG. 1 is an isometric view of the pouch of the present invention.
Figure 2:
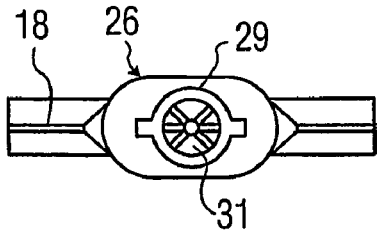
FIG. 2 is a top view of the pouch of FIG. 1.
Figure 3A:
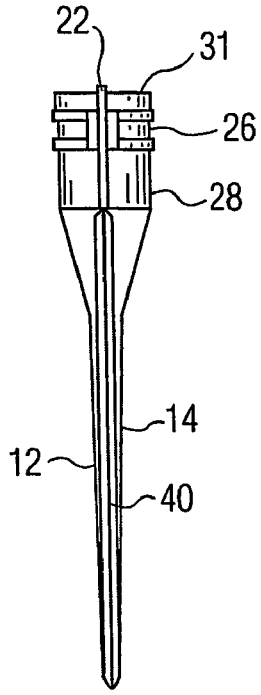
FIGS. 3A and 3B are side elevational views showing the side gusset structure of the pouch when unfilled and filled, respectively.
Figure 3B:
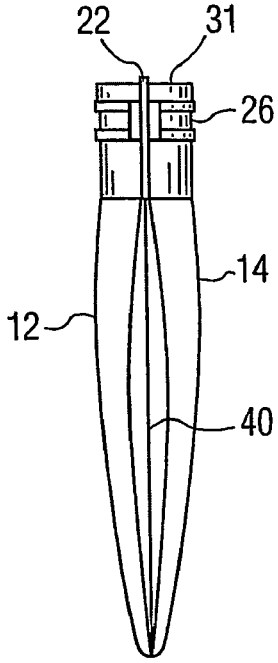
Figure 4:
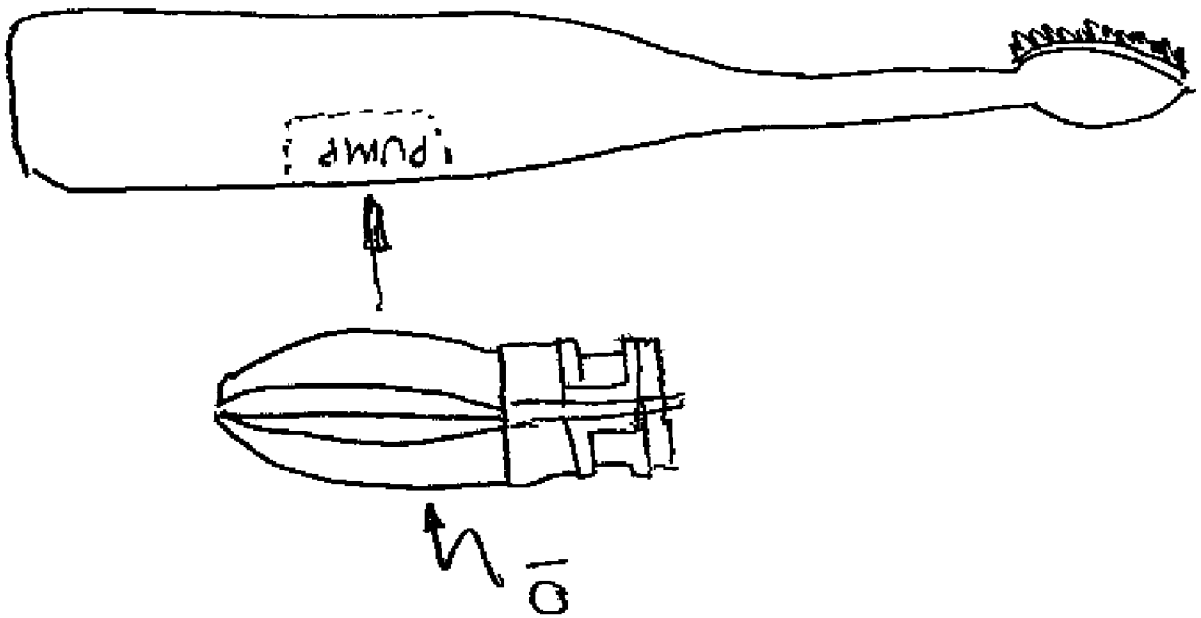
FIG. 4 is a side elevational view of a combination of a fluid-dispensing toothbrush with a pump and the pouch of FIG. 1.

Referring now to FIG. 1, the pouch/container 10 of the present invention for carrying fluid for a personal hygiene device includes front and rear panel portions 12 and 14. The front and rear panel portions in the embodiment shown are made from flexible material such as thin plastic or metal film, sealed along a bottom edge 16. In the embodiment shown, the pouch 10 is made from a single sheet of laminate, although this is not necessary.

The top edge 18 is sealed as well but has an irregular, i.e. jogged, configuration, including two side wing portions 20 and 22 and a lower central portion 24. In central portion 24 is located a spout element 26 intermediate of front and rear panel portions. The front and rear panel portions 12 and 14 are sealed to opposing sides of a lower portion 28 of spout 26, such that the spout 26 is completely sealed to the front and rear panel portions. Spout 26 has a central opening 29 which extends into and communicates with the interior of pouch 10. Within the spout central opening 29 is a valve 31 which is adapted to connect with a fluid pump which in operation moves fluid present in the pouch from the pouch to connecting elements, such as a tube, and then to a workpiece, such as a shaver head or a toothbrush.

The above elements, specifically the workpiece and the connecting elements, are not shown or described in detail, since they form no part of the present invention, and since a wide variety of such elements can be used with the particular pouch shown and described.

The side wing portions 20 and 22 extend above the central portion 24 on either side thereof to a point which is, in the embodiment shown, slightly above the top 31 of spout element 26. Each side wing portion 20, 22 is sealed at its top edge 30 thereof and down an inner side edge 32, where it meets with the central portion 24 which is sealed to the spout, as discussed above. Hence, the top edge 18 is sealed fluid-tight completely across container 10. The sealed section of each side wing portion is approximately 0.6 cm wide, similar to the width of the sealed section of central portion 24 to spout 26. Hence, the top edge 18 of the pouch 10 has a seal which extends from edge to edge of pouch 10, providing a fluid-tight seal at the top thereof. Each side wing portion has a small remaining section thereof in which the front and rear panel portions are not sealed together. These sections 23, 25 extend inwardly from the respective longitudinal side edges approximately 6 cm and are open to the interior volume of the pouch.

Each side edge 36 and 38 of pouch 10 is formed with a longitudinal gusset 40. Gusset 40, for example, extends from the bottom edge 16 all along the side edge up to the lower edge 27 (which extends out to the side edge 38) of the side wing portion. The open sections 23, 25 of the side wing portions allow each gusset to open to its full effect over the length of the pouch (from bottom edge 16 to the lower edge 27 of the side wing portion). The gusset structure is advantageous, since it permits the unfilled pouch to be substantially flat when unfilled and then to expand to a full depth as the pouch is pre-filled with fluid. In the embodiment shown, this is approximately 15 mL. This arrangement permits the filled pouch to readily take irregular configurations, conforming to irregular volumes in which the pouch is positioned within the personal hygiene device.

The open (non-sealed) sections 23, 25 of the side wing portions allows the full effect of gusset 40 on each side of the pouch to occur, with respect to filling of the pouch. In the embodiment shown, the filled pouch is approximately 10 mm thick, i.e. gusset 40 is approximately 10 mm wide (2 sheets of 5 mm each). Gussets with different widths can, of course, be used.

In use, the pouch is simply fitted onto a pump in the personal hygiene device. When the pouch is empty, after several uses, the old pouch is simply removed and a new pouch put in its place. The pouch is designed to hold in volume a plurality (up to 28) of individual uses of the fluid. As one example, the container has a capacity of 15 mL of fluid. The fluid itself could be various dentifrices, both conventional and medicinal, in the case of a toothbrush, including bacterial agents for treating particular oral diseases, such as gum disease, or in the case of a shaver could be a fluid which assists in the shaving function or treatment for the skin in some manner.

Hence, the pouch has a particular structural configuration which allows the filled container to fit various spaces in an efficient, practical manner.

Although a preferred embodiment of the invention has been disclosed for purposes of illustration, it should be understood that various changes, substitutions and modifications may be incorporated in the embodiment without departing from the spirit of the invention which is defined by the claims that follow.

The invention claimed is:

1. A flexible container for a fluid, for use with a personal hygiene device, comprising:

a flexible bag pre-filled with a dentifrice or shaving fluid having a front panel portion and a rear panel portion and sealed along a bottom edge thereof, defining an interior volume for fluid, and further having a gusset along each longitudinal edge thereof which connect the front and rear panel portions thereof and allow the front and rear panel portions to expand away from each other when the bag is filled, wherein the bag includes two sealed wing portions of substantially equal width on either side of a central portion at a top end thereof, wherein the central portion is sealed to a spout element which is constructed to permit exit of fluid from the bag after it has been filled, wherein the sealed central portion extends beyond opposing sides of the spout element to the wing portions, wherein the wing portions extend above the central portion of the bag, terminating approximately in the plane of a top edge of the spout element, and wherein the wing portions each include an inner edge which extends to the central portion separately from the spout element, wherein the wing portions each include an open section which extends above the gusset in fluid communication with the interior volume of the container, the open sections extending inwardly from opposing side edges of the container a small distance compared to the width of the container, the remainder of the wing portions, to the central portion, being sealed, such that the fluid in the pre-filled bag extends into the open sections but not the sealed remainder of the wing portions, wherein the open sections each have a width approximately equal to the sealed remainder of the wing portions, and wherein the sealed remainder of the wing portions have a width similar to the sealed section of the central portion, which extends to the spout element, the open sections allowing the gusset to expand fully, permitting the bag to fill completely.

2. The container of claim 1, wherein the personal hygiene device is a power toothbrush.

3. The container of claim 1, wherein the spout element includes a valve to permit exit of fluid therefrom.

4. A combination of a fluid-dispensing toothbrush and a fluid container, comprising:

a fluid-dispensing toothbrush which includes a pump; and a flexible bag pre-filled with a dentifrice fluid for cleaning teeth having a front panel portion and a rear panel portion and sealed along a bottom edge thereof, defining an interior volume for the fluid, and further having a gusset along each longitudinal edge thereof which connect the front and rear panel portions and allow the front and rear panel portions to expand away from each other when the bag is filled, wherein the bag includes two sealed wing portions of substantially equal width on either side of a central portion at a top end thereof, wherein the central portion is sealed to a spout element which is constructed to permit exit of fluid from the bag after it has been filled, wherein the sealed central portion extends beyond opposing sides of the spout element to the wing portions, wherein the wing portions extend above the central portion of the bag, terminating approximately in the plane of the top edge of the spout element, and wherein the wing portions include an inner edge which extends to the central portion separately from the spout element, wherein the wing portions each include an open section which extends above the gusset in fluid communication with the interior volume of the bag, the open sections extending inwardly from opposing side edges of the bag a small distance compared to the width of the container, the remainder of the wing portions, to the central portion, being sealed, such that the fluid in the pre-filled bag extends into the open sections but not the sealed remainder of the wing portions, wherein the open sections have a width approximately equal to the sealed remainder of the wing portions and wherein the sealed remainder of the wing portions have a width similar to the sealed section of the central portion, which extends to the spout element, the open sections allowing the gusset to expand fully, permitting the bag to fill completely, wherein the flexible bag fits onto and is removable from the pump in the fluid-dispensing toothbrush.

* * * * *